United States Patent [19]

Ikesue

[11] 4,154,522

[45] May 15, 1979

[54] ELECTROSTATOGRAPHIC APPARATUS COMPRISING IMPROVED DRUM CLEANING MEANS

[75] Inventor: Masumi Ikesue, Tokyo, Japan

[73] Assignee: Ricoh Company, Ltd., Tokyo, Japan

[21] Appl. No.: 824,917

[22] Filed: Aug. 15, 1977

[30] Foreign Application Priority Data

Aug. 20, 1976 [JP] Japan ..... 51-99280

[51] Int. Cl.[2] ..... G03G 21/00

[52] U.S. Cl. ..... 355/15; 15/256.51; 118/652

[58] Field of Search ..... 355/15; 15/1.5, 256.51, 15/256.52; 118/652

[56] References Cited

U.S. PATENT DOCUMENTS

| | | | |
|---|---|---|---|
| 3,700,328 | 10/1972 | Davidge et al. | 355/15 |
| 3,728,016 | 4/1973 | Harbour et al. | 15/1.5 R |
| 3,917,398 | 11/1975 | Takahashi et al. | 355/15 |
| 3,918,808 | 11/1975 | Narita | 15/1.5 R |

*Primary Examiner*—R. L. Moses

*Attorney, Agent, or Firm*—David G. Alexander

[57] ABSTRACT

A scraper blade or roller engages the surface of a photoconductive drum and causes residual toner substance to pile up. The pile of residual toner is then released and carried by the drum to a position where it is removed therefrom by gravity, another scraper blade or a magnetic brush which bifunctions as a developing means. A groove may be formed in the drum surface into which the piled-up residual toner substance drops to be carried away for removal. A bias electrode or electromagnet which attracts the toner substance may replace the groove.

15 Claims, 6 Drawing Figures

ELECTROSTATOGRAPHIC APPARATUS COMPRISING IMPROVED DRUM CLEANING MEANS

BACKGROUND OF THE INVENTION

The present invention relates to an electrostatographic apparatus such as an electrostatic copying machine comprising an improved means for removing residual toner substance from a photoconductive member in the form of a drum, belt or the like.

In a typical electrostatic copying machine, a photoconductive member such as a drum is electrostatically charged and radiated with a light image of an original document, forming an electrostatic image through localized photoconduction. A dry toner substance is applied to the drum which forms a visible toner image thereon. The toner image is transferred and fixed to a sheet of copy paper to provide a permanent copy of the original document.

However, it is impossible in practical application to transfer all of the toner substance to the copy sheet, and a residual amount always remains. This residual toner substance must be removed from the drum prior to a subsequent copying operation to prevent double printing. From an economic standpoint, it is desirable to recycle rather than discard the residual toner substance after remove from the drum.

Various means have been proposed heretofore to remove residual toner substance from a drum and return the same to the developing unit of the copying machine. All such prior art means are rather complicated, and disproportionally increase the overall size and cost of the copying machine.

Whereas residual toner return in copying machines utilizing liquid toner is rather simple due to the fact that liquid toner readily flows downwardly through conduits and the like under the force of gravity, such return of dry powdered toner substance is hampered by the forces of dry friction, electrostatic and magnetic attraction, etc., even if air pressure or vacuum is utilized to facilitate movement.

In one known electrostatic copying machine a fur brush is used to remove the residual toner substance from the drum and a vacuum pump sucks the toner from the brush and returns the same to the developing unit through a conduit system. Such an arrangement, in addition to the drawbacks mentioned hereinabove, invites contamination of the toner substance due to accumulation of dirt and dust on the fur brush.

Another prior art expedient for residual toner removal and recycling utilizes a scraper blade to remove the toner from the drum and a conveyor comprising an elongated worm screw to return the toner substance to the developing unit. The conveyor may have one or more sections comprising endless belts or chains. This arrangement is especially disadvantageous due to excessive complexity, size and cost.

SUMMARY OF THE INVENTION

The present invention overcomes the above described drawbacks of the prior art by utilizing a scraper blade, roller or similar friction member to engage with a photoconductive drum and scrapingly cause residual toner substance to pile up in front of the friction member. The blade or roller is then released, allowing the pile of toner substance to be carried by the drum, without the need of an auxiliary conveyor, to a position where it is removed from the drum.

It is an object of the present invention to provide an electrostatographic apparatus comprising an improved means for removing residual toner substance from the surface of a photoconductive drum, belt or the like.

It is another object of the present invention to reduce the size of an electrostatic copying machine by providing improved means for removing residual toner from the drum thereof.

It is another object of the present invention to reduce the complexity and manufacturing cost of an electrostatic copying machine through rationalized residual toner removal and recycling.

It is another object of the present invention to provide a generally improved electrostatographic apparatus.

Other objects, together with the foregoing, are attained in the embodiments described in the following description and illustrated in the accompanying drawing.

DESCRIPTION OF THE PREFERRED EMBODIMENTS

While the electrostatographic apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
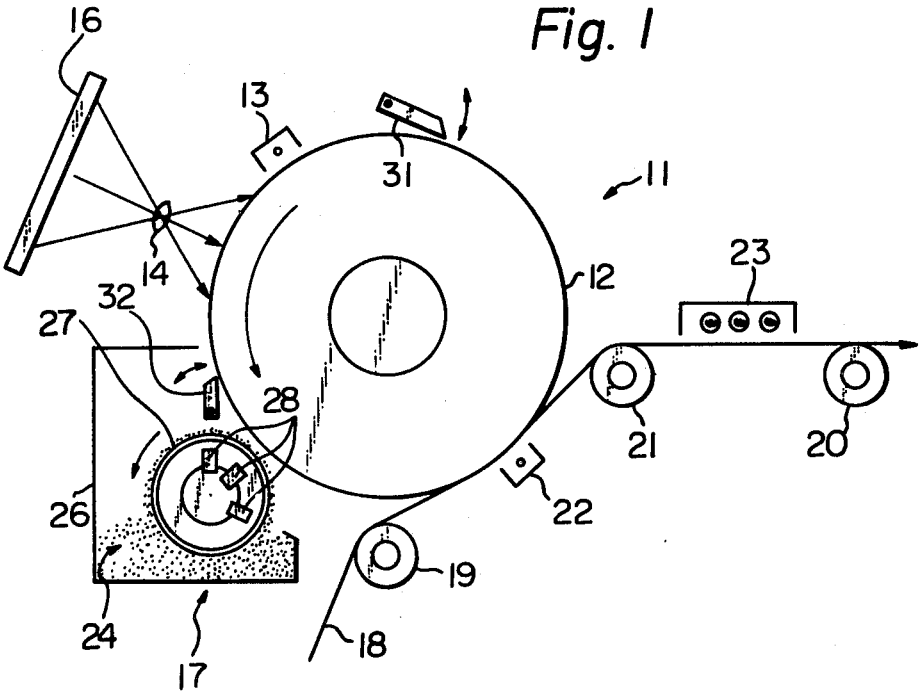
FIG. 1 is a schematic diagram of an electrostatic copying machine embodying the present invention.

Referring now to FIG. 1 of the drawing, an electrostatographic apparatus embodying the present invention is shown in the form of an electrostatic copying machine which is generally designated by the reference numeral 11. The copying machine 11 comprises a photoconductive drum 12 which is rotated counterclockwise at constant speed. A corona charging unit 13 applies a uniform electrostatic charge to the surface of the drum 12 and an optical system which is symbolized by a converging lens 14 focusses a light image of an original document 16 onto the drum 12. This causes the formation on the drum 12 of an electrostatic image through localized photoconduction. A developing unit 17 applies a dry, powdered toner substance onto the surface of the drum 12 to form a toner image through electrostatic attraction. A sheet of copy paper 18 is fed in contact with the drum 12 in a synchronized manner by means of feed rollers 19 and 21. A transfer charger 22 applies an electrostatic charge through the back of the copy sheet 18 which causes the toner image to be transferred and adhered to the copy sheet 18. A feed roller 20 conveys the copy sheet 18 under a fixing unit 23 which applies sufficient heat to the copy sheet 18 to melt the toner substance and fuse the same to the copy sheet 18 to provide a permanent reproduction of the original document 16.

The developing unit 17 comprises a magnetic brush 24 which is rotatably disposed in a developing tank 26 which is filled with powdered toner substance. The magnetic brush 24 comprises a non-magnetic cylinder 27 which is rotated counterclockwise in close proximity to the drum 12 at constant speed. A plurality of permanent magnets 28 are fixedly mounted inside the cylinder 27. Rotation of the cylinder 27 and the attraction of the magnets 28 causes a layer of toner substance to adhere to the surface of the cylinder 27 in the form of a brush which brushingly engages with the drum 12. This brushing operation produces development of the electrostatic image on the drum 12 into a toner image. The toner substance may consist only of tiny ferromagnetic particles which are black in color or coated with a layer of black resin. Alternatively, the toner substance may consist of a homogeneous mixture of ferromagnetic carrier particles and non-magnetic, black resin toner particles. In the latter case, only the toner particles are attracted to the drum 12 to form the toner image.

As discussed hereinabove, it is necessary to remove residual toner substance from the surface of the drum 12 after the transfer operation to prevent double printing. In accordance with the present invention, the apparatus 11 comprises first and second scraper blades 31 and 32 which are movable into and out of engagement with the surface of the drum 12. The scraper blades 31 and 32 are preferably made of a rubber or a similar substance which will not damage the delicate photoconductive layer on the drum 12. During the normal portion of the copying operation described hereinabove, the blades 31 and 32 are maintained out of engagement with the drum 12.

Figure 2:
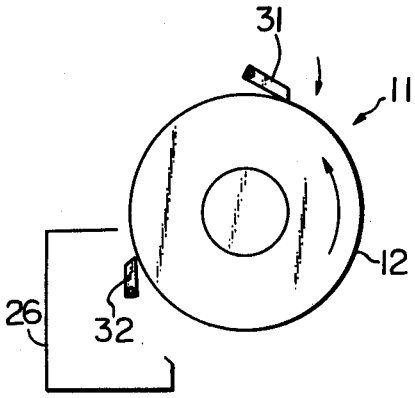
FIGS. 2 and 3 are simplified schematic diagrams illustrating the operation of the embodiment of FIG. 1.
Figure 3:
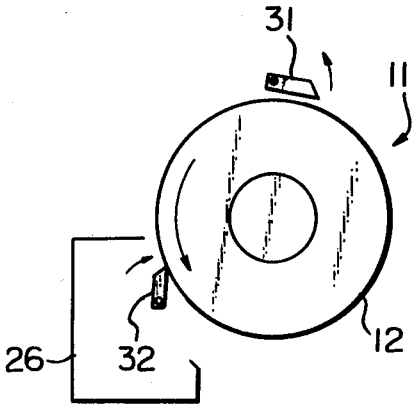

To accomplish removal of residual toner substance from the drum 12, the scraper blade 31 is first moved into frictional engagement with the drum 12 as shown in FIG. 2. This causes the toner substance to be scrapingly removed from the drum 12 and pile up in front, or to the right as viewed in the drawing, of the scraper blade 31. After the drum 12 has made a complete revolution, the scraper blade 31 is moved out of engagement with the drum 12 and the scraper blade 32 is moved into engagement with the drum 12 as illustrated in FIG. 3. It will be noted that the scraper blade 32 is downstream of the scraper blade 31 in the direction of movement of the drum 12.

The scraper blade 31 is disposed sufficiently above the drum 12 that any toner substance which piles up in front of the scraper blade 31 will not be able to slide down the right side of the drum 12 under the force of gravity. This is determined by the frictional force between the toner substance and drum 12, the rotational speed of the drum 12, and similar practical factors.

When the scraper blade 31 is disengaged from the drum 12, the pile of residual toner substance is carried on the surface of the drum 12 to the scraper blade 32 which scrapingly removes the piled-up toner substance from the drum 12. It will be noted that the angle of the scraper blade 32 relative to the drum 12 is such that the toner substance will be caused by the force of gravity to slide down the back of the scraper blade 32 and fall into the developing tank 26. After the pile of toner substance is removed from the drum 12 by the scraper blade 32, the scraper blade 32 is moved out of engagement with the drum 12 in preparation for another copying operation. Where a number of copies are to be made of a single original document and it is not desirable to remove the residual toner substance after each transfer operation, an electronic or mechanical apparatus (not shown) may be provided to initiate the residual toner removal operation only after the last copy is made.

Figure 4:
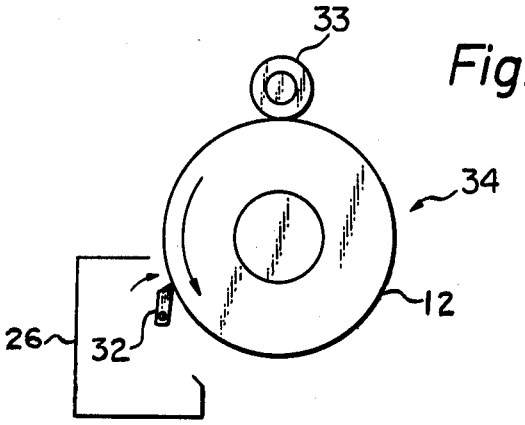
FIG. 4 is similar to FIGS. 2 and 3 but illustrates a second embodiment of the present invention.

FIG. 4 shows a second embodiment of the present invention in which the scraper blade 31 is replaced by a roller 33. Like elements are designated by the same reference numerals and the apparatus of FIG. 4 is generally designated as 34. The roller 33 may be utilized in several different ways.

During the normal portion of the copying operation prior to residual toner removal, the roller 33 may either be disengaged from the drum 12, moved into engagement with the drum 12 and allowed to be rotatably driven thereby or driven under power in engagement with the drum 12. In the latter two cases, the roller 33 is rotated clockwise, or in the opposite direction to the drum 12. This means that the contacting surfaces of the drum 12 and roller 33 move in the same direction.

For causing the residual toner to pile up in front of the roller 33, the roller 33 may be either stopped or caused to rotate counterclockwise, in the same direction as the drum 12. In the latter case, the surfaces of the drum 12 and roller 33 which contact each other move in opposite directions.

In all embodiments of the present invention, the scraper blade 32 may be omitted if alternative means are provided to remove the piled-up toner substance from the drum 12. Under certain circumstances, said means may be the drum 12 itself, which is adapted to have a diameter and coefficient of friction such that the toner substance is caused to fall from the drum 12 into the developing tank 17 under the force of gravity. As another alternative, the magnetic brush 24 may be used to remove the piled-up toner substance.

Figure 5:
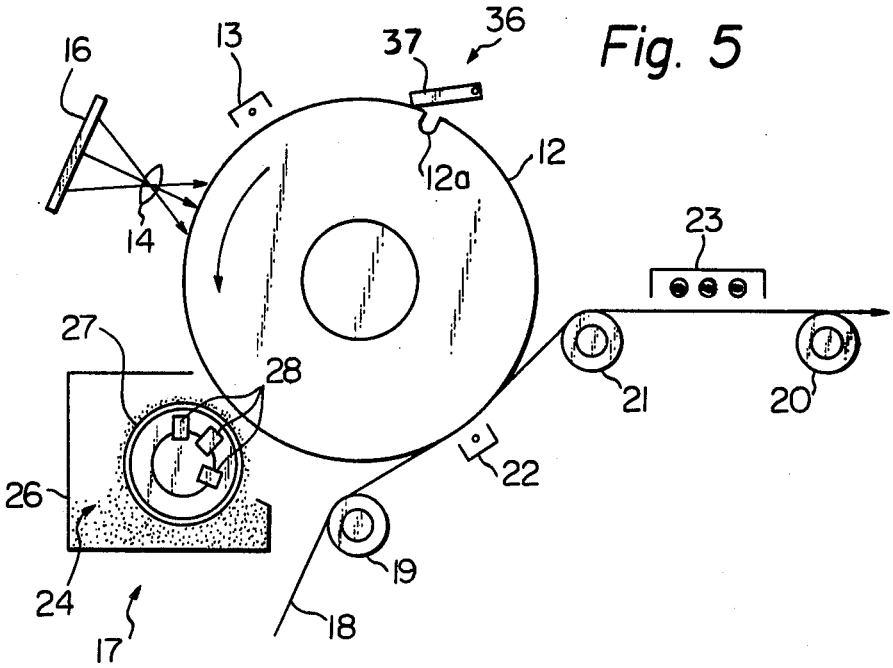
FIG. 5 is similar to FIG. 1 but illustrates a third embodiment.

FIG. 5 shows a third embodiment of the present invention in which the scraper blade 32 is omitted. Whereas the scraper blade 31 is shown as engaging with the drum 12 due to a clockwise rotational force, in an apparatus 36 of FIG. 5 a scraper blade 37 is caused to engage with the drum 12 due to a counterclockwise rotational force. Furthermore, the scraper blade 37 is maintained in constant contact with the drum 12.

In the apparatus 36, a longitudinal groove **12*a* is formed in a non-image area of the drum 12 coextensively therewith. The scraper blade 37 causes the residual toner substance to pile up in front thereof in the same manner as described with reference to FIG. 1. However, when the groove 12*a* reaches the scraper blade 37, the piled-up toner substance is pushed into the groove 12*a* by the scraper blade 37 and is carried thereunder by the drum 12. The toner substance remains in the groove 12*a* until the groove 12*a* reaches the developing tank 26 and is oriented sufficiently downwardly. At this point, the toner substance falls out of the groove 12*a* under the force of gravity into the developing tank 26**.

Figure 6:
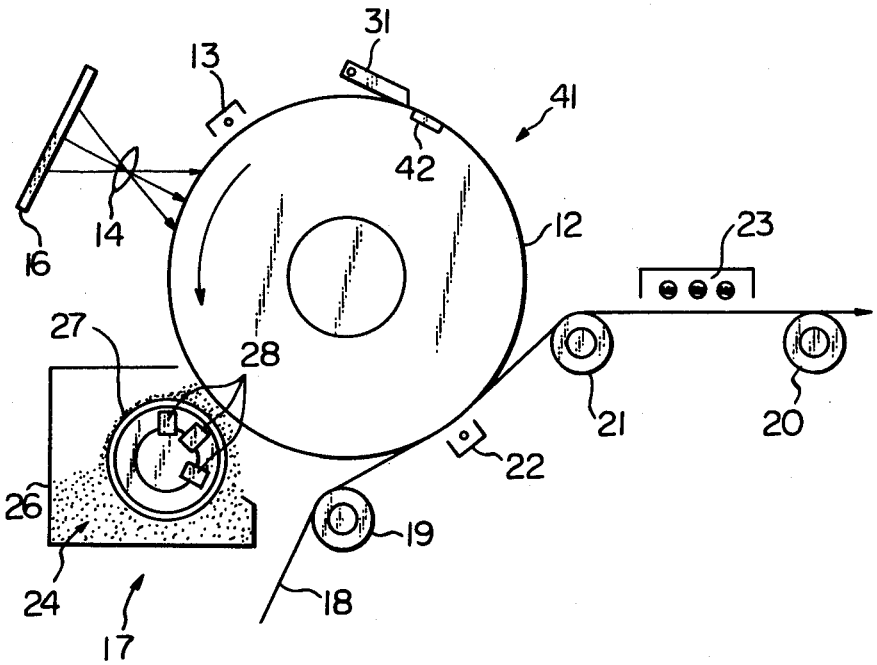
FIG. 6 is similar to FIG. 5 but illustrates a fourth embodiment.

FIG. 6 shows a fourth embodiment of the present invention in the form of an apparatus which is generally designated as 41. The apparatus 41 is similar to the apparatus 36 except that the groove **12*a* is replaced by an elongated attraction means 42 which may be a bias electrode or an electromagnet. As another point of difference, the apparatus 41 utilizes the scraper blade 31 rather than the scraper blade 37**.

In operation, the residual toner substance is piled up by the scraper blade 31 until the means 42 reaches the blade 31, as illustrated in FIG. 6. At this point, the means 42 is energized and the scraper blade 31 disengaged from the drum 12. The means 42 attracts the toner substance thereto and thereby aids the frictional force between the drum 12 and toner substance in carrying the toner substance to the developing tank 26. When the pile of toner substance does reach the tank 26, the means 42 is de-energized allowing the toner substance to drop into the developing tank 26 under the force of gravity. Whereas the toner substance is of the one-component type, comprising only ferromagnetic toner particles, the attraction means 42 is provided in the form of an electromagnet. Whereas the toner substance is of the two-component type and the residual toner substance contains only non-magnetic toner particles, the attraction means 42 is provided in the form of a bias electrode. The electromagnet and bias electrode provide magnetic and electrostatic attractive forces respectively on the residual toner substance.

In summary, it will be seen that the present invention provides a simplified but improved means for removing residual toner substance from the drum, belt or the like of an electrostatographic apparatus such as an electrostatic copying machine. Various modifications will become possible for those skilled in the art after receiving the teachings of the present disclosure without departing from the scope thereof. The present invention may be applied to either a one-rotation copying machine or a two-rotation copying machine. In the latter case the magnetic brush is utilized for development during a first rotation of the drum and for cleaning or removal of residual toner substance during a second rotation of the drum. Whereas two scraper blades or gravity removal of residual toner substance is utilized in accordance with the present invention, a two-rotation copying machine can be transformed into a one-rotation copying machine with an attendent doubling of the copying speed.

What is claimed is:

1. In an electrostatographic apparatus including a moving photoconductive member, developing means for applying a toner substance to the photoconductive member to develop an electrostatic image into a toner image and transfer means for transferring the toner image from the photoconductive member to a copy sheet, the combination therewith comprising:

first means engageable with the photoconductive member to cause residual toner substance to pile up on the photoconductive member in front of the first means; and second means for removing the piled-up residual toner substance from the photoconductive member, the second means being spaced downstream of the first means in a direction of movement of the photoconductive member.

2. An apparatus as in claim 1, in which the first means comprises a friction member which is moved into engagement with the photoconductive member to cause the residual toner substance to pile up and subsequently moved out of engagement with the photoconductive member to allow the piled-up residual toner substance to be carried by the photoconductive member to the second means.

3. An apparatus as in claim 2, in which the friction member comprises a scraper blade.

4. An apparatus as in claim 2, in which the friction member comprises a roller.

5. An apparatus as in claim 1, in which the first means is maintained in engagement with the photoconductive member.

6. An apparatus as in claim 5, in which the first means comprises a scraper blade.

7. An apparatus as in claim 5, in which the first means comprises a roller.

8. An apparatus as in claim 7, in which the roller is stopped to cause the residual toner substance to pile up and subsequently rotated so that a surface of the roller engaging the photoconductive member moves in a same direction as the photoconductive member to allow the piled-up residual toner substance to be carried by the photoconductive member to the second means.

9. An apparatus as in claim 7, in which the roller is rotated so that a surface of the roller engaging the photoconductive member moves in a direction opposite to the photoconductive member to cause the residual toner substance to pile up and subsequently rotated so that the surface of the roller engaging the photoconductive member moves in a same direction as the photoconductive member to allow the piled-up residual toner substance to be carried by the photoconductive member to the second means.

10. An apparatus as in claim 1, in which the first means comprises a scraper blade maintained in engagement with the photoconductive member and a groove formed in a surface of the photoconductive member which engages with the scraper blade.

11. An apparatus as in claim 1, in which the first means comprises a scraper blade engageable with the photoconductive member and a bias electrode attached to a surface of the photoconductive member which is engageable with scraper blade.

12. An apparatus as in claim 1, in which the first means comprises a scraper blade engageable with the photoconductive member and an electromagnet attached to a surface of the photoconductive member which engages with the scraper blade.

13. An apparatus as in claim 1, in which the second means comprises a scraper blade which is engageable with the photoconductive member to remove the piled-up residual toner substance.

14. An apparatus as in claim 1, in which the developing means comprises a magnetic brush, the second means being constituted by the magnetic brush.

15. An apparatus as in claim 1, in which the photoconductive member is formed in such a manner that the piled-up residual toner substance is caused to fall therefrom by gravity.

* * * * *